United States Patent [19]

Szymber et al.

[11] Patent Number: 5,052,252

[45] Date of Patent: Oct. 1, 1991

[54] SELF-LOCKING AND RELEASING GRIPPING TOOL

[75] Inventors: Oleg Szymber, Arlington Heights, Ill.; Eustathios Vassiliou, Newark, Del.

[73] Assignee: Patcore, Incorporated, Newark, Del.

[21] Appl. No.: 594,547

[22] Filed: Oct. 9, 1990

[51] Int. Cl.[5] ..... B25B 7/06

[52] U.S. Cl. ..... 81/416; 81/318; 81/324; 81/339

[58] Field of Search ..... 81/315, 318–320, 81/324, 329, 331, 339, 416

[56] References Cited

U.S. PATENT DOCUMENTS

| | | | |
|---|---|---|---|
| 681,487 | 8/1901 | Quist . | |
| 1,271,911 | 7/1918 | Kearney . | |
| 1,408,524 | 3/1922 | Long . | |
| 1,528,247 | 3/1925 | Cruickshank . | |
| 1,625,615 | 4/1927 | Kuttes . | |
| 2,370,308 | 2/1945 | Hanson | 81/329 |
| 3,261,243 | 7/1966 | Ellison | 81/351 |
| 3,354,759 | 11/1967 | Cook | 81/379 |
| 3,681,844 | 8/1972 | Priest | 81/416 X |
| 4,542,669 | 9/1985 | Roux | 81/418 |
| 4,890,520 | 1/1990 | Vassiliou | 81/365 |

*Primary Examiner*—James G. Smith
*Attorney, Agent, or Firm*—E. Vassiliou

[57] ABSTRACT

A gripping tool, acting as both a pair of pliers and a wrench, self locks and self releases upon application or removal of clamping torque on the handles of the tool, respectively. The locking and releasing mechanism is based on reversible wedging action.

18 Claims, 10 Drawing Sheets

SELF-LOCKING AND RELEASING GRIPPING TOOL

FIELD OF THE INVENTION

This invention relates to a self adjusting tool and more particularly to a gripping tool that locks and releases automatically upon application or removal of clamping torque on the handles.

BACKGROUND OF THE INVENTION

Gripping tools usually take the form of either a pair of pliers or of an adjustable wrench depending on the particular job for which they are intended to perform.

A problem typical of pliers is that after they have gripped an article, the exerted pressure on the article continues to increase with sometimes deleterious results. Furthermore the gripping force of the jaws varies as a function of the gripping pressure on the handles of the pliers by the operator. An advantage of the pliers is that they are very easy and fast to attain an open or closed configuration, by simply opening or closing the handles.

On the other hand, adjustable wrenches do not attain the open or closed configuration nearly as easily and fast as pliers, and they do not have the gripping power of pliers, but they lock in a series of positions, thus avoiding the deleterious effects of uncontrollable excessive pressure.

The advantages and disadvantages of these gripping tools result mainly from the fact that the jaws of the pliers operate through a rotational motion around a pivot point, while in the case of the adjustable wrenches, the jaws move in a linear sliding mode. Many attempts have been made so far to attain the advantages and eliminate the disadvantages of both mechanisms in a single tool without success.

One category of such attempts, represented for example by U.S. Pat. No. 4,542,669, involves the so-called "vise grip pliers", the mechanisms of which are based on the "over the center" principle. Although these tools are invaluable when used as portable vises, they lack fast operation as that encountered in common pliers, since their jaws have to be brought first to close proximity to the size of the article to be gripped, usually through a screw mechanism, and then brought to the final gripping position by energizing the "over the center mechanism" as a second operation. In addition, a separate lever has to be pressed at the end of the operation for releasing the gripping force.

To avoid the necessity of the initial step, Ellison (U.S. Pat. No. 3,261,243) uses a rachet/toggle clamp, which engages as an "over the center position is approached. However, an additional separate lever has to be pressed again for releasing the gripping force.

Another type of adjustable wrenches, which however, also lack the advantages of pliers, since among other problems both hands of the operator have to be employed for their use, are described for example in U.S. Pat. Nos. 681,487 and 1,408,524. Both employ engaging means in the form of two flat sets of teeth which engage each other to prevent further movement of the jaws after an article has been gripped thereinbetween.

In U.S. Pat. No. 1,528,247 there is shown a pair of pliers including a pin, which can be rotated to lock the jaws of the pliers in a limited number of predetermined positions.

A somewhat improved version of this type of locking devices is shown in U.S. Pat. No. 1,271,911, where a pin is automatically inserted into a rachet mechanism during the gripping operation of the jaws. However, this mechanism also lacks the continuum of locking positions needed for making this tool actually useful and practical. For one pin to counteract successfully the huge forces acting on it, it has to have sizeable dimensions, thus considerably limiting the number of locking positions.

Although a gripping tool disclosed in U.S. Pat. No. 4,890,520 is a considerably improved version of the type of tools described above, regarding easy and fast operation, its lock-release mechanism requires high accuracy, and therefore it may not be easily and inexpensively mass-produced.

SUMMARY OF THE INVENTION

The present invention solves these vexing problems through a gripping tool comprising in combination an assembly of:

(a) a first member having a first hub, a first jaw rigidly connected to the first hub, and a first handle extending from the first hub in a direction substantially opposite to the direction of the first jaw;

(b) a second member having a second hub, a second jaw rigidly connected to the second hub, and a second handle extending from the second hub in a direction substantially opposite to the direction of the second jaw, the second member being pivotally connected to the first member through a first pivot hole on the second hub, the first handle and the second handle constituting a handle set, and the first jaw and the second jaw constituting a jaw set, and the second hub having an outer clutching surface; and (c) wedging means for reversibly locking the tool, comprising a clutch section having an inner clutching surface commensurate to the outer clutching surface, and a first wedge directionally coupled with the first hub, and being adaptable to create adequate pressure between the inner clutching surface and the outer clutching surface, so as to reversibly lock the second member with respect to the first member when a clamping torque exceeding a predetermined value is applied on the handle set, the clamping torque corresponding to a simultaneous resistive torque created on the jaws by an object gripped in the jaw set.

Preferably, the inner clutching surface is directionally coupled with the first hub, and even more preferably, the gripping tool further comprises means for deactivating at will the first wedge and precluding the tool from being adaptable to create adequate pressure between the inner clutching surface and the outer clutching surface, thus temporarily preventing the second member to reversibly lock with respect to the first member, and allowing the gripping tool to be used temporarily as a regular pair of pliers.

BRIEF DESCRIPTION OF THE DRAWING

The present invention will be best understood from the following description taken together with the accompanying drawings in which.

DETAILED DESCRIPTION OF THE INVENTION

Figure 1:
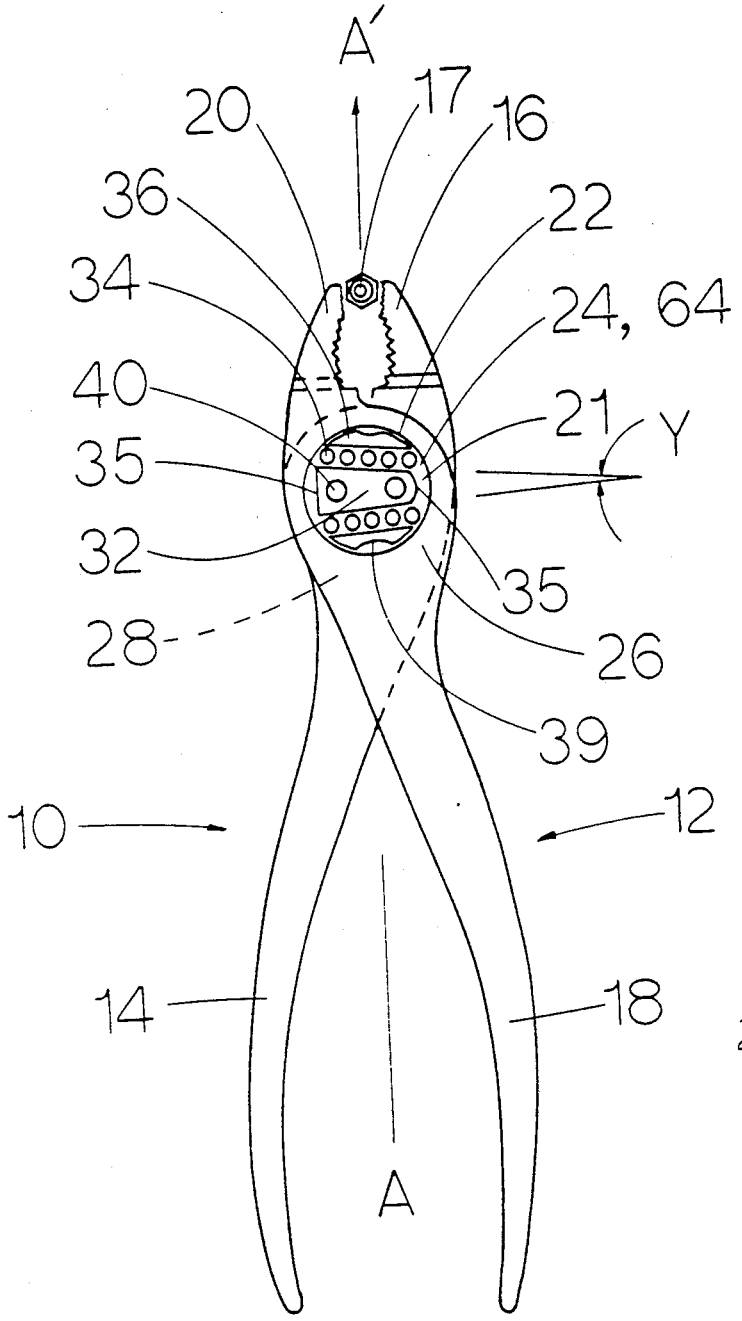
FIG. 1 shows a schematic representation of the top view of a preferred embodiment of a gripping tool without the cover plate in accordance with the present invention.
Figure 3:
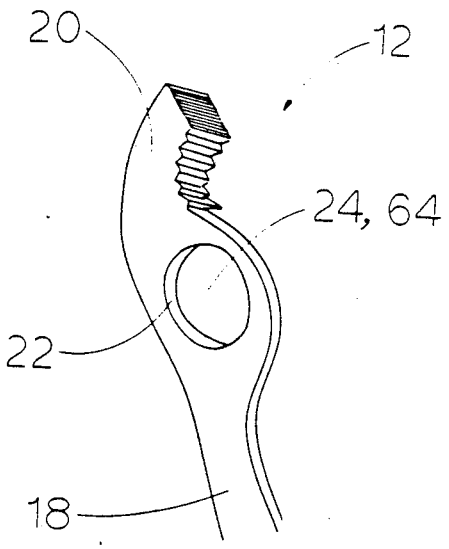
FIG. 3 shows a stylized perspective view of the second member shown also in FIGS. 2*a* and 2*b*.
Figure 2A:
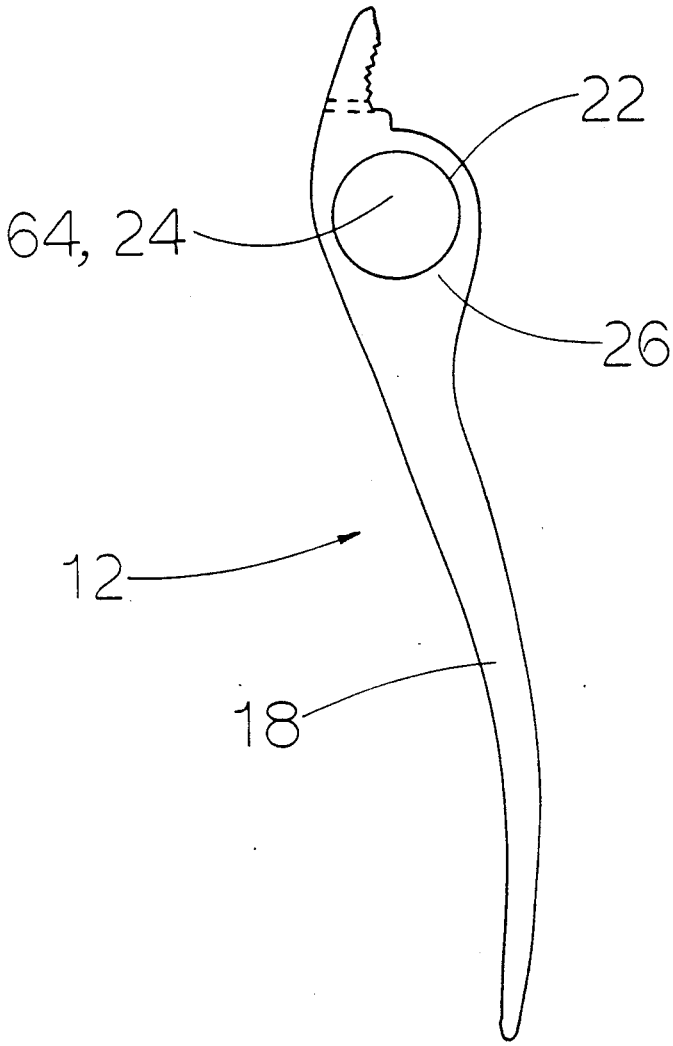
FIG. 2*a* shows the top view of the second member of the embodiment illustrated in FIG. 1.
Figure 2B:
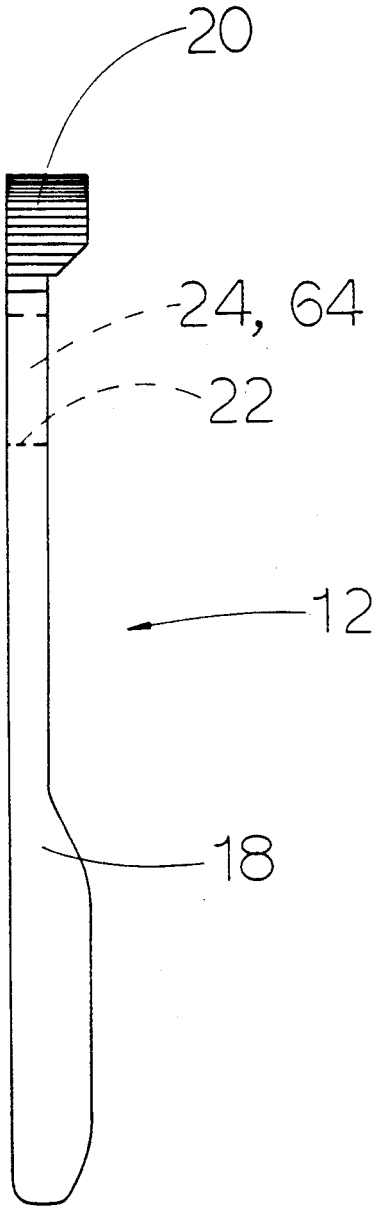
FIG. 2*b* shows the side view of the second member of the embodiment illustrated in FIG. 1.
Figure 4A:
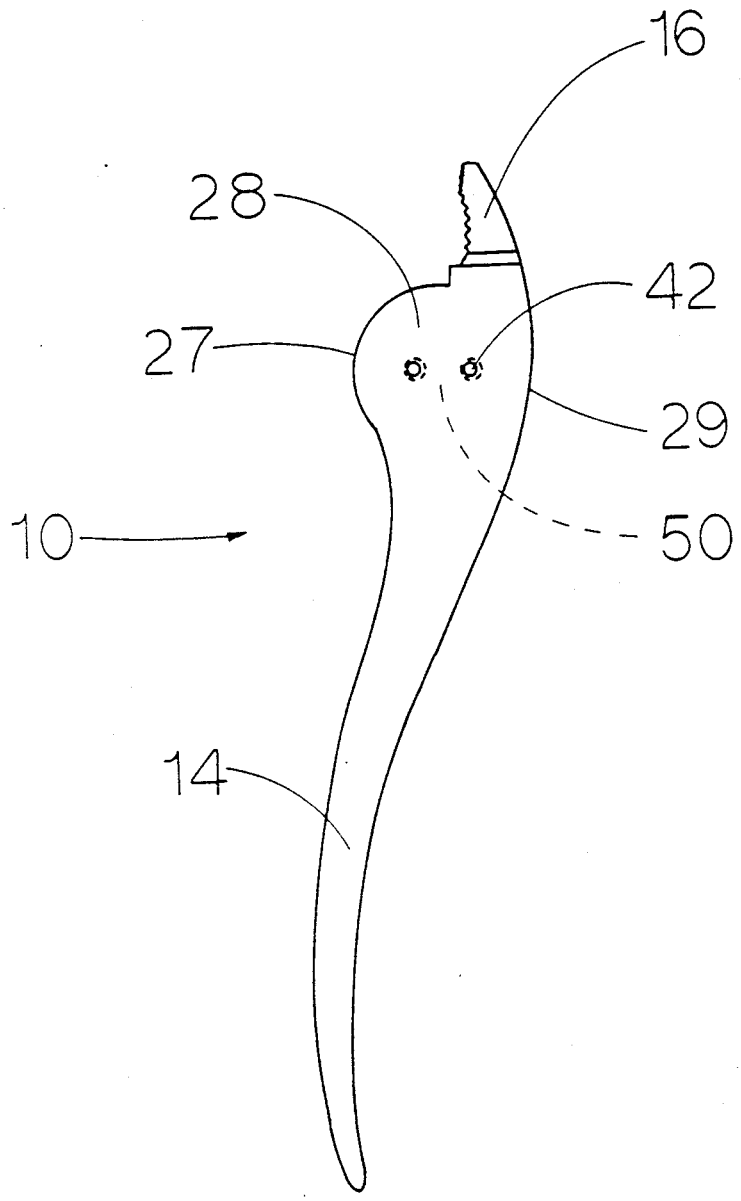
FIG. 4*a* shows the top view of the first member of the embodiment illustrated in FIG. 1.
Figure 4B:
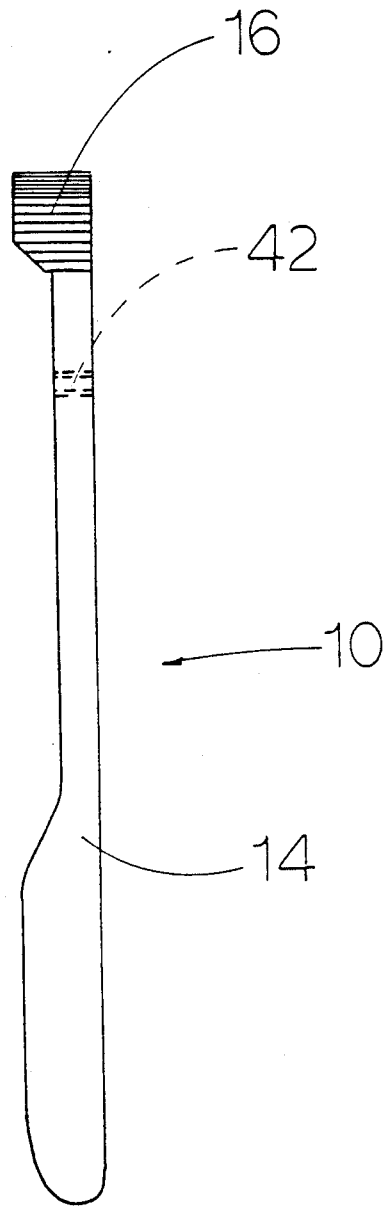
FIG. 4*b* shows the side view of the first member of the embodiment illustrated in FIG. 1.

Referring now to FIGS. 1 to 7, there is depicted a gripping tool, such as a pair of pliers constructed in accordance with a preferred first embodiment of the present invention.

The gripping tool or pliers comprise an assembly of a first member 10 and a second member 12. The first member 10 includes a first hub 28, a first jaw 16, which is preferably rigidly connected to the first hub 28, and a first handle 14, which extends from the first hub 28 in a direction substantially opposite to the direction of the first jaw 16. The second member 12 has a second hub 26, a second jaw 20, which is preferably rigidly connected to the second hub 26, and a second handle 18 extending from the second hub 26 in a direction substantially opposite to the direction of the second jaw 26.

The second member 12 is pivotally connected to the first member 10 through a first pivoting hole 64 on the second hub 20.

In this embodiment, the pivoting hole 64 is the same as or coincides with a round hole 24 having an outer clutching surface 22. In turn, the outer clutching surface 22 is preferably concurrent or it coincides with the perimetry of the round hole 24. Thus, in the case of this particular embodiment, the outer clutching surface is the perimetry of the round hole 24 or the pivoting hole 64.

The first handle 14 and the second handle 18 are disposed at one side of the gripping tool, and they are adaptable to cooperate with each other, thus constituting a handle set 14-18. This means that for the tool to perform its intended function, the whole handle set 14-18 is actuated as a unit and not only one of the two handles 14 and 18. In a similar manner, the first jaw 16, and the second jaw 20 are disposed at the opposite side of the gripping tool, and they are adaptable to cooperate with each other as constituting a jaw set 16-20. This means that for the tool to perform its intended function, the whole jaw set 16-20 is also actuated as a unit and not only one of the two jaws 16 and 20.

As aforementioned, the first member 10 is pivotally connected to the second member 12 between the jaw set and the handle set, in a way that the jaws 16 and 20, and the handles 14 and 18 may open and close simultaneously and freely when no resistive torque is present between the jaws. Resistive torque is created, for example, when an object, such as a nut 17 for example, is gripped within the jaw set 16-20, and a clamping or tightening torque is applied on the handle set 14-18, by the hand of an operator of the tool, for example. When speaking of a resistive torque on the jaw set, or a clamping torque on the handle set, reference is implied to the opposing torques on each individual jaw or handle respectively.

Figure 5:
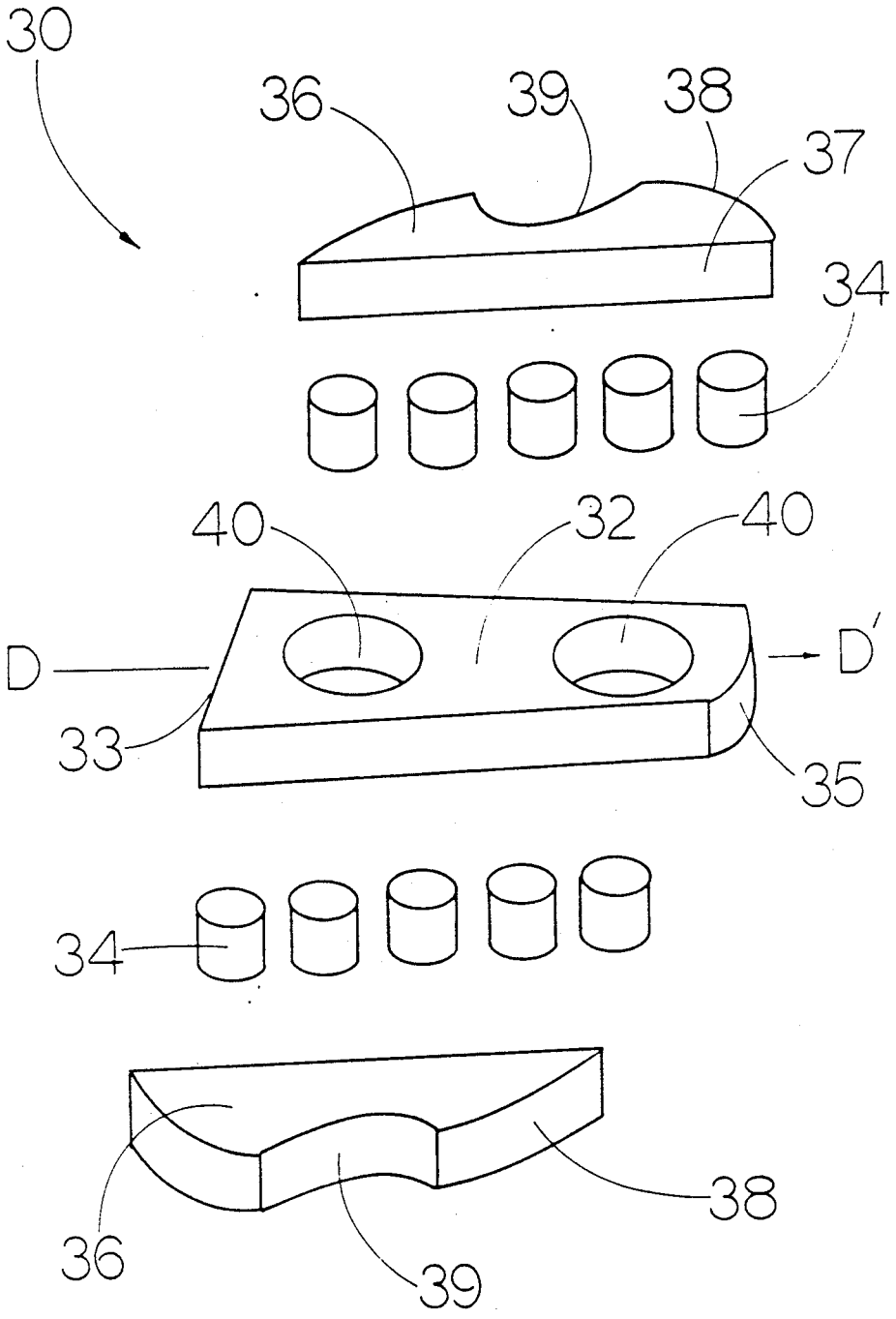
FIG. 5 shows a stylized perspective view of the wedging means used in the gripping tool shown in FIG. 1.

The gripping tool also has wedging means 30 comprising in this case a clutch section 36, as better shown in FIG. 5, having an inner clutching surface 38 commensurate to the outer clutching surface 22, and a first wedge 32. The first wedge 32 is directionally coupled with the first hub, and is adaptable to create adequate pressure between the inner clutching surface 38 and the outer clutching surface 22, so as to reversibly lock the second member with respect to the first member when a clamping torque exceeding a predetermined value is applied on the handle set 14-18. This clamping torque corresponds to a simultaneous resistive torque created on the jaws by an object gripped in the jaw set 16-20. By "directionally coupled" it is meant that when the first hub 28 is caused to turn or to stop, then the first wedge is also caused to turn or to stop at the same time, and vice-versa. In this particular embodiment, the first wedge 32 is preferably rigidly connected to the first member 10, in a central territory of the first hub 28, between the first handle 14 and the first jaw 16. Any number of ways may be used to achieve this rigid connection or securement. For a mass manufactured product, it is preferable that the first wedge 32 is an integral part of first member 10. Usually and preferably, such parts and part combinations are manufactured by forging. In addition, the first wedge 32 is preferably also responsively connected to the first handle 14, as also illustrated for handle 314 in an other preferred embodiment shown in FIG. 10. By "responsively" it is meant that a desired response of the first wedge 32 is obtained upon actuation of the first wedge 32 by the first member 10, so that the first wedge 32 performs its intended function.

Continuing now with the embodiment depicted in FIGS. 1-7, the wedge to reversibly lock the second member 12, meaning that locking of the tool is in effect for as long as the clamping torque on the handle set and the respective resistive torque on the jaw set are being applied, and that at most, frictional forces must be overcome in order to unlock the tool and allow again free movement of the jaws and the handles. Thus, the tool performs its functions in the absence of latching mechanisms, which require additional levers or mechanisms to be activated or deactivated in order to free the tool after the tool has been locked. In the case of the present invention, at most a simple push on one of the handles, having an opposite direction to that of the previously applied clamping torque for locking the tool, is adequate to free the tool again.

The wedging means 30 according to this particular embodiment of this invention also comprise two arcuate clutch sections 36 having inner clutching surfaces 38, and flat surfaces 37, as better illustrated in FIG. 5. The inner clutching surfaces 38 are parts of a circle having a diameter substantially equal to the diameter of the hole 24 of the second member 12. Preferably, the inner clutching surfaces 38 are interrupted by the recessed portions 39 in order to ensure better clutching strength, especially if either the surfaces 38 or the surface 22 deviate or develop deviations from circular roundness. Thus, a circular engagement takes effect when the first wedge 32 creates adequate pressure between the inner 38 and the outer 22 clutching surfaces.

In addition to the above, the wedging means 30 also may comprise friction-reducing means, such as for example rollers 34, which are disposed between the first wedge 32 and the flat surfaces 37 of the clutch sections 36, during the operation of the tool. Of course, balls, cones, and any other shapes used in bearings for reduction of friction may be used. The rollers are preferable to the balls because they presenting higher surface contact, and therefore are less susceptible to damage regarding themselves, or any matching surface.

In assembling the self-locking gripping tool, the first wedge 32 is positioned within the hole 24 of the second member 12, in a way that the second hub 26 is in close contact with the first hub 28. The clutch sections 36 and the rollers 34 are placed on either side of the first wedge 32, as better illustrated in FIG. 1. It is preferable that the dimensions of the arcuate clutch sections 36, of the rollers 34, and of the first wedge 32 are such that they just fit in the hole 24, without however producing excessive pressure on the outer clutching surface 22 of the second member 12, which pressure would not allow free opening and closing of the handle set 14-18 and the jaw set 16-20 in the absence of resistive torque in the jaw set 16-20. A free space 21 should be allowed between the small side 35 of the first wedge 32 and the outer clutching surface 22, in order to permit movement of the first wedge 32 with respect to the round hole 24. It is also preferable that the general direction D—D' of the first wedge 32, defined as the direction from the large side 33 toward the small side 35, as shown in FIG. 5, is perpendicular to the general direction (FIG. 1) of the tool along a central axis A—A' passing through the pivoting point of the two members, and on one side of which there are disposed the first handle 14 and the second jaw 20, while on the other side of the central axis, there are disposed the second hand 18 and the first jaw 16. This is one of the characteristic elements differentiating regular pairs of pliers and "vise-grip" types of tools. It is further important that the large side 33 of the first wedge 32 is disposed (FIG. 4*a*) toward the interior edge 27 of the first hub 28 of the first member 10, and the small side 35 of the first wedge 32 is disposed toward the exterior edge of the hub first 28 of the first member 10.

The wedging means, including the first wedge 32, the clutch sections 36, and the rollers 34, assembled in this manner within the hole 24, also serve in this case as a pivot between the first member 10 and the second member 12.

Figure 6:
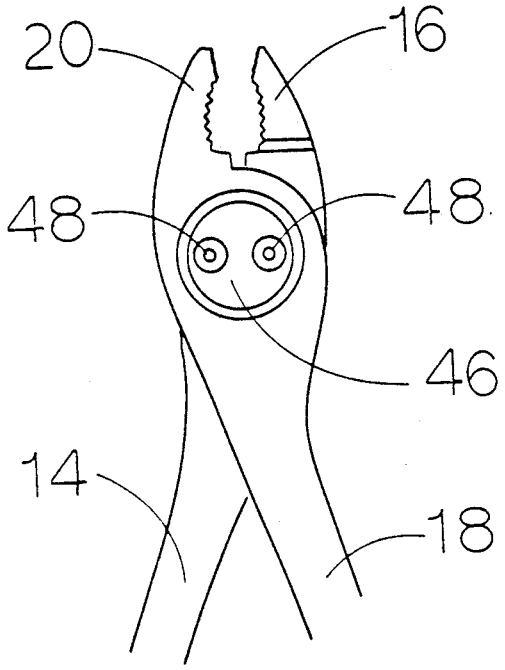
FIG. 6 shows a fragmented view of the top side of the embodiment of the gripping tool shown in FIG. 1, with the cover plate in place.
Figure 7:
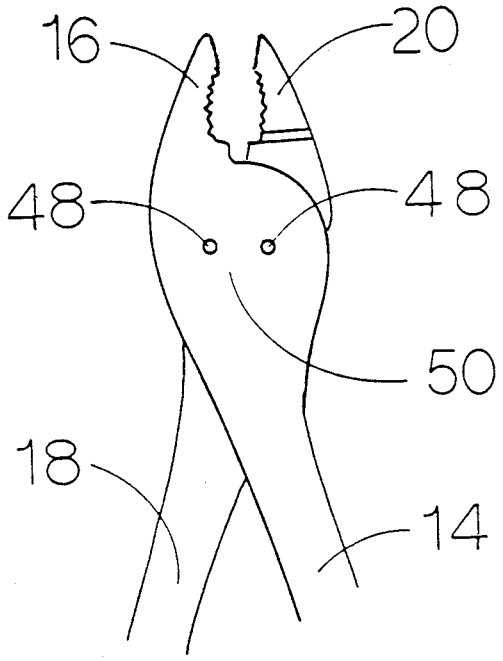
FIG. 7 shows a fragmented view of the back side of the embodiment of the gripping tool shown in FIG. 1.

To prevent involuntary disassembling of the tool, as well as to rigidly secure the first wedge 32 on the first member 10, a cover plate 46 covering the hole 24, as shown in FIG. 6, is also rigidly secured on the first wedge 32 by bolts 48, which pass through the openings 40 of the first wedge 32, and are engaged on the threaded perforations 42 (see FIGS. 4*a* and 4*b*) of the first member 10. The cover plate 46 prevents the elements of the wedging means to fall off, and also prevents the two members 10 and 12 from separating. It is evident that use of bolts in securing different elements is cited only for exemplary purposes, and any other types of fastening, such as for example welding, forging, press fitting, rivetting, and the like may be used in any place where bolts are cited in this invention. Also instead of fastening element together, forging and other techniques may be used to create parts containing, usually in an integral manner, these elements in place, so that no external fastening is needed.

The thickness of the first wedge 32 is slightly larger than the thickness of the second hub 26, so that the cover plate 46, which has a diameter larger than the diameter of the hole 24 or 64, allows free pivotal movement of the first member 10 with respect to the second member 12. The thickness of the first wedge 32 should not be, however, too large as compared to the thickness of the second hub 26 in order to avoid sloppy movement, considerably diverging from pivotal sliding movement.

The value of the angle Y (FIG. 5) of the first wedge 32 should be such as to permit good clutching ability between the clutch sections 36 and the clutching surface 22 when clamping torque is applied on the handle set 14-18 accompanied by a respective resistive torque in the jaw set 16-20, but also easy release of the clutching action when the torques are cancelled. The smaller the angle, the smaller the clamping torque required for a given clutching strength or ability. Also, the smaller the angle the longer the distance that the first wedge 32 will have to travel in order to achieve a given clutching strength. The selection of the angle depends on the desirable clutching strength characteristics of the tool.

The length of the first wedge should be such as to prevent the rollers 34 from entering the free space 21 between the small side 35 of the first wedge 32 and the perimeter 22 of the hole 24, or the region between the back side 33 of the first wedge 32 and the perimeter 22. Angle values for the angle Y of 5 to 10 degrees are preferable, while values of 6 to 8 degrees are more preferable.

In operation, the tool is initially behaving like a normal pair of pliers when no object is gripped within the jaw set 16-20, and therefore no resistive torque is applied on the jaws. When, however, an object, such as for example nut 17 is gripped by the jaw set, and clamping force is applied by an operator on the handle set, there is created a movement of the first wedge with respect of the hole, in a direction from the large side 33 of the first wedge toward the small side 35 of the first wedge 32, since the first wedge has been arranged to be directed in this manner, as shown in FIG. 1. As the first wedge 32 is forced to move in this direction, pressure is applied on the rollers 34 by the first wedge 32, which pressure is simultaneously applied on the clutch sections 36, and in turn between the inner clutching surface 38 and the outer clutching surface 22, thus reversibly locking the first and the second members of the tool with respect to each other. The nut 17 may then be turned by the tool without additional forces tending to open the handles, since the tool is locked and it behaves like a wrench. The operator then at will, may release the clamping torque from the handle set, and at most give a push having an opposite direction to the previously applied clamping torque, to one of the handles, and the tool behaves again as a regular pair of pliers, so that the nut or other object may be gripped in a different position and locked again in the same manner. The same operation may be repeated as desired.

For angles Y of the first wedge 32 having relatively large values, locking of the first member with respect to the second member is in effect for as long as a clamping torque is being applied on the handle set 14-18, when a respective resistive torque is developed on the jaw set 16-20. As soon as the clamping torque is released, the lock is dissolved. On the other hand, if the angle has a relatively small value, the lock may remain in effect even after removal of the clamping torque from the handle set 14-18, due to higher friction, and a reverse torque or push has to be applied on the handles to dissolve the lock. Depending on the intended end use of the tool, one or the other condition may be incorporated in the design of the tool, and prevail.

Figure 8A:
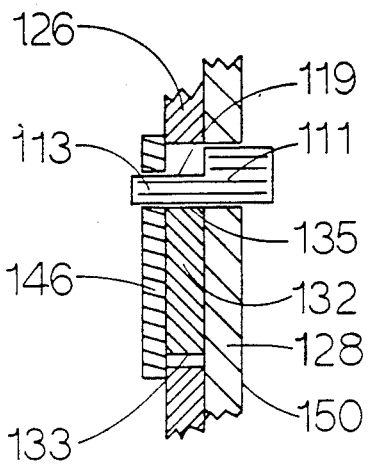
FIG. 8*a* shows a fragmented cross section in the general region of the wedging means, of a different embodiment of the present invention with a sliding deactivating pin in a "push-out" position for activating the first wedge.
Figure 8B:
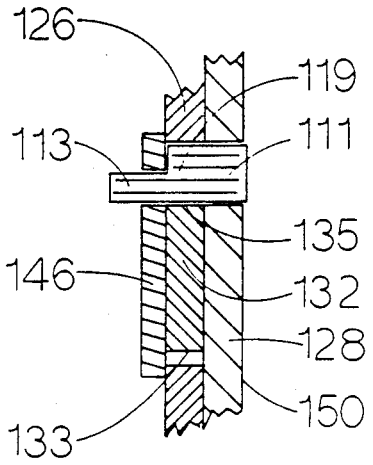
FIG. 8*b* shows a fragmented cross section in the general region of the wedging means, of the embodiment shown in FIG. 8*a* with the sliding deactivating pin in an "push-in" position for deactivating the first wedge.

In a preferred second embodiment, better illustrated in a fragmental cross-sectional view in FIGS. 8*a* and 8*b*, there is provided deactivating means, such as for example a sliding pin 119 having a full-cylindrical portion 111, and a semi-cylindrical portion 113. The sliding deactivating pin 119 extends through the first hub 128, the small side 135 of the first wedge 132, and the cover plate 146. The pin 119 may slide in a direction perpendicular to the back surface 150 of the first hub 128, in a way that its full-cylindrical portion 111 may fill or be away from the free space 121. Openings 140 are not shown in these figures for purposes of better clarity.

The operation of the second embodiment is similar to the one described above, when the deactivating pin is in a "push-out" position, as better illustrated in FIG. 8*a*. In this configuration, the pin does not fill the free space 121 between the front part 135 of the first wedge 132 and the perimeter 122. Thus, the first wedge 132 may be caused to move and behave in a substantially identical manner as in the first embodiment described above. However, when the pin is pushed in a way to slide so that the full-cylindrical portion 111 fills the free space 121, as better illustrated in FIG. 8*b*, movement of the first wedge in a direction from the large side 133 to the small side 135 of the first wedge 132 is prevented, and thus no locking action may take place, and the gripping tool behaves at all times that the deactivating pin 119 is in this "push-in" position as a regular pair of pliers. Depending on the particular design of the tool or the side of the tool from which the in is operated, a "push-out" position may be such as either to activate or to deactivate the first wedge, and "push-in" position may be such as to either deactivate or to activate the first wedge respectively.

Figure 9A:
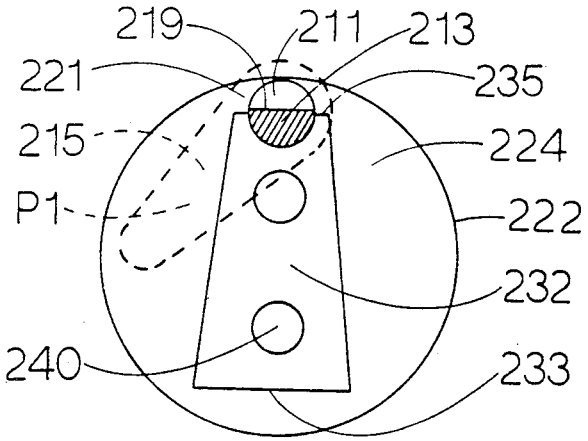
FIG. 9*a* shows a fragmented cross section in the general region of the wedging means, of still a different embodiment of the present invention with a rotational deactivating pin in a "turn-right" position for activating the first wedge.
Figure 9B:
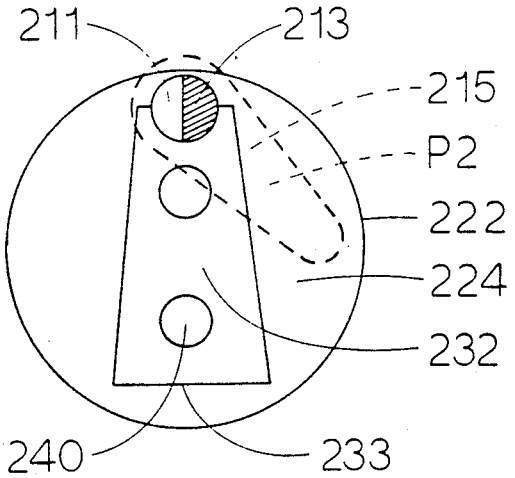
FIG. 9*b* shows a fragmented cross section in the general region of the wedging means, of the embodiment shown in FIG. 9*a* with the rotational deactivating pin in a "turn-left" position for deactivating the first wedge.

FIGS. 9*a* and 9*b*, show a fragmental view of a preferred third embodiment of this invention. In this embodiment, a rotational deactivating pin 219, similar in shape to pin 119 and having a position analogous to that shown for pin 119 in FIG. 8*a*, may assume a "turn-right" and a "turn-left" position by rotating or turning rather than by sliding the pin. Rotational deactivating pin 219, also has a full-cylindrical portion 211, and a semi-cylindrical portion 213. FIG. 9*a* shows the round hole 224 and the first wedge 232 within it. Rollers and clutch sections have been omitted for clarity purposes.

The rotational deactivating pin 219 is rigidly connected to a lever 215. When the lever 215 is positioned in "turn-right" position P1 by an operator, as shown in FIG. 9*a*, the free space 221 allows movement of the first wedge in a direction from the large side 233 toward the small side 235 of the first wedge 232, and the gripping tool operates substantially in the same manner as it does in the case of the first embodiment.

When the lever 215 is positioned in a "turn-left" position P2, as better shown in FIG. 9*b*, by an operator, the turned semi-cylindrical portion 219 prevents any movement of the first wedge 232 in a direction from the large side 233 toward the small side 235 of the first wedge 232, and the tool behaves again as a regular pair of pliers, since the first wedge 232 may not provide any locking action under these conditions. Of course, again depending on the design of the tool, or the side of the tool on which the lever 219 is located, the "turn-left" position may be such as to either activate or deactivate the first wedge 232, and the "turn-right" position may be such as to either deactivate or activate the first wedge 232, respectively.

Figure 10:
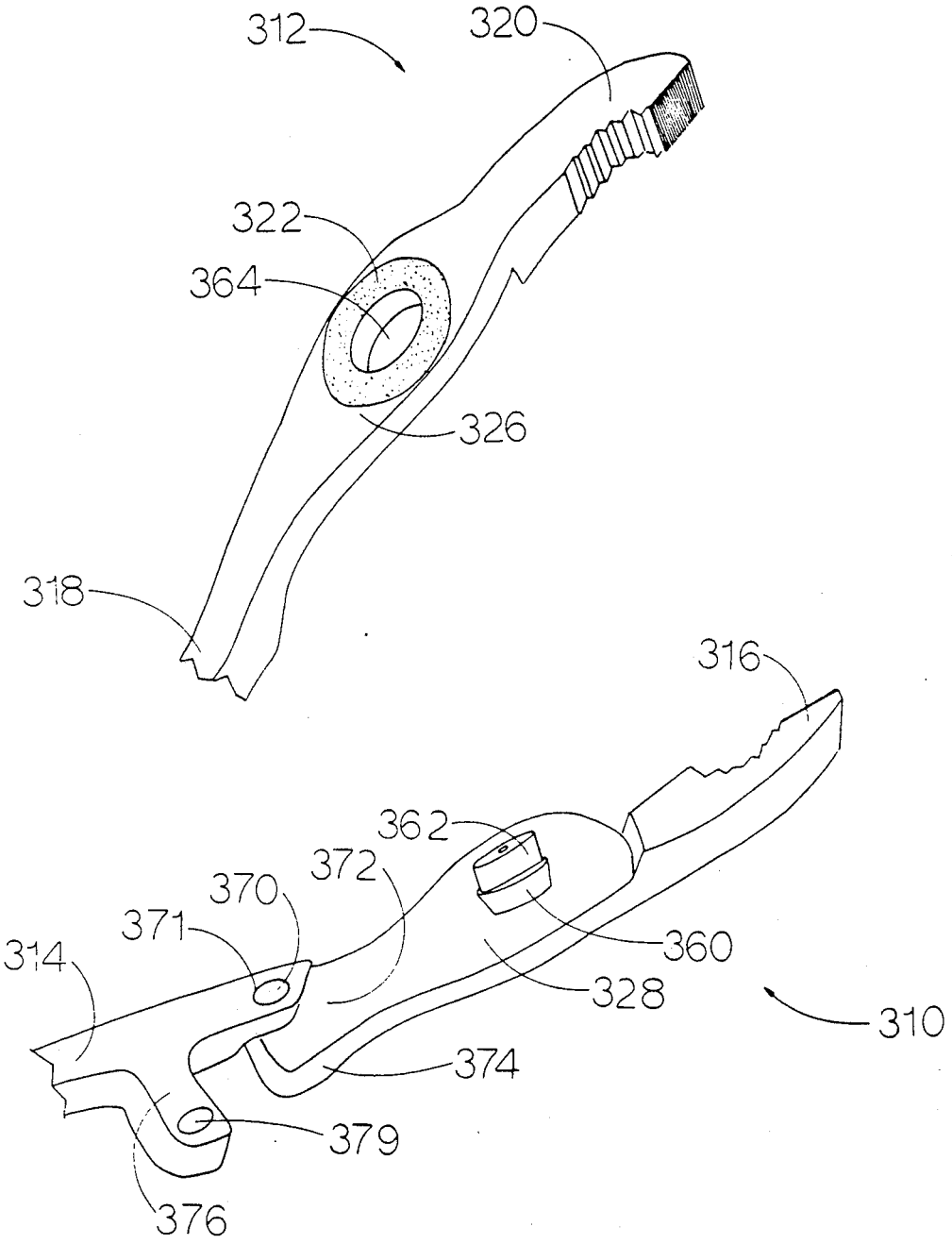
FIG. 10 shows a fragmented perspective view of the first and the second members according to another preferred embodiment of this invention.
Figure 11:
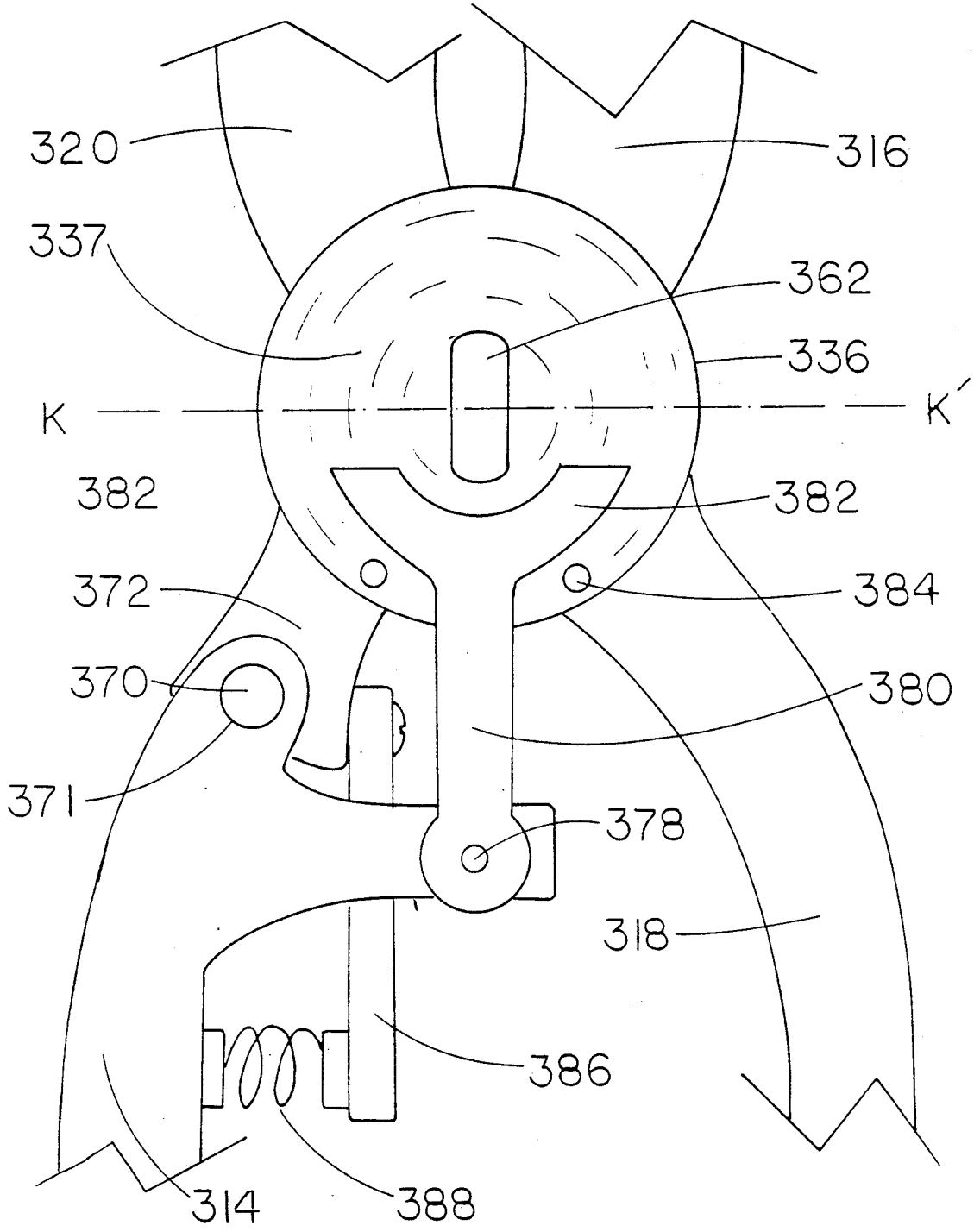
FIG. 11 shows a fragmented view of a partially assembled gripping tool according to the embodiment of FIG. 10.
Figure 12:
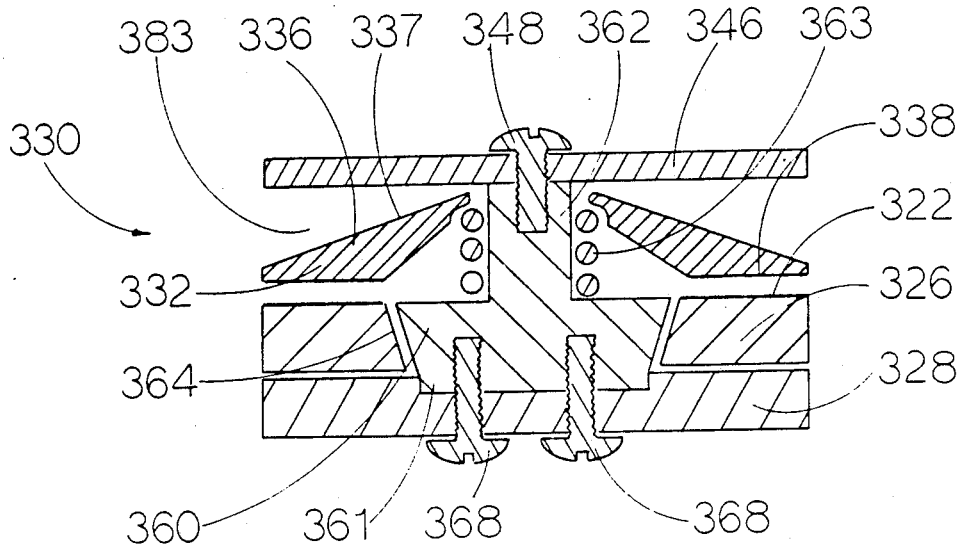
FIG. 12 shows a fragmented partial view of a wedging means, in combination with part of the first and second hubs of the tool.

FIGS. 10-12 illustrate a fourth preferred embodiment according to the instant invention, again in the form of a pair of pliers.

FIG. 10 shows the first member 310 and the second member 312 of the pliers. The first member comprises a first jaw 316, which extends to a first hub 328 having rigidly connected in a central area, a first pivot 360 ending to a clutch guide 362. The thickness of the first pivot 360 on top of the first hub 328, is approximately the same as the thickness of the first hub 328, and the thickness of the second hub 326 belonging to the second member 310. The first pivot 360 has a reverse conical shape in order to support the second hub 326 in a pivotal cooperation with the first hub 328, and prevent it from separating from the first hub 328. The first pivot also has a projecting section 361 entering a respective hollow portion in hub 328, as better shown in FIG. 12.

The first hub 328 also has an extension 372 disposed in a direction opposite to that of the direction of the first jaw 316. The extension 372 of the first hub 328 has a flat portion 374, and it is pivotally connected to a first handle 314, by a second pivot 370 passing through a second pivoting hole 371. The first handle 314 has in turn a preferably integrally connected branch 376, extending from the first handle 314 toward the second handle 318, in an approximately perpendicular direction to the general direction of the tool. The branch 376 has a third pivoting hole 379 at one end of the branch 376 away from the second handle 314.

The second member 312 comprises a second jaw 320, integrally connected to a second hub 326. A second handle 318 is also integrally connected to the hub in a diametrically opposite position with respect to the jaw 320. The second hub 326 has a first pivoting hole 364, commensurate to the first pivot 360, and an outer clutching surface 322. The outer clutching surface 322 is preferably rough to promote friction. In the case of this embodiment, the outer clutching surface 322 does not coincide with the first pivoting hole 364.

FIG. 11 shows the gripping tool or pliers in a semi-assembled stage for better clarity. The missing parts not shown in FIG. 11 are a cover plate 346 and a bolt 348 connecting the cover plate 346 to the clutch guide 362, as better shown in FIG. 12. There is also provided a spring arm 386, rigidly connected at one end to the flat portion 374 of the extension 372 of the first hub 328. A first bias compression spring is connected between the other end of the spring arm 386 and the handle 314 tending to keep the handle 314 away from the spring arm 386, and from the second handle 318. Of course, in other arrangements an extension spring instead of a compression spring might be appropriate to bias the first handle away from the second handle. A wedge connector 380 is pivotally connected at one end to the branch 376 by a third pivot 378 passing through the pivoting hole 379. The wedge connector 380 has a fork portion 382 at the other end. The fork portion 382 is disposed within a first wedge region 383, restricted by the cover plate 346 and the flat surface 337 of a clutch section 336, as better shown in FIG. 12. Two retaining pins 384 disposed on either side of the wedge connector 380 and supported on the flat surface 337 of the clutch section 336 limit the backward movement of the wedge connector 380, and in turn the opening degree of the first handle 314.

FIG. 12 representing a reversible wedging means, shows a cross section of the tool by a plane perpendicular to the plane of the tool and passing through line K—K', and also includes the cross section of the cover plate 346 and bolt 348, at the same position. The clutch section 336 has a preferably rough inner clutching surface 338, commensurate to the outer clutching surface 322 of the second hub 326. The flat surface 337 of the clutch section 336 is in an angle with the cover plate 346, forming a first wedge configuration, in a way that if a solid object such as the fork portion 382 is forced to move in the first wedge region toward the central region, where the clutch guide 362 is located, the clutch section 336 is forced to move toward the second hub 326. Friction reducing means (not shown for purposes of clarity) may preferably be used in this case also between the fork portion 382 and the surface 337, in a similar manner as aforementioned in previously described embodiments. The clutch section 336 is kept away from the second hub 326 by a second bias compression spring 363. At this position, the second hub 326 is free to turn around the first pivot 360, which is connected rigidly to the first hub 328 with bolts 368. The clutch guide 362 has a non-circular cross section, and the clutch section 336 has a commensurate opening for the non-circular cross section of the clutch guide to fit in, so that if one turns the other has to turn along with it, and if one is locked, the other cannot move either. In this manner, the clutch section 336, which also serves as a first wedge 332, due to its shape, is directionally coupled with the first hub 328.

In operation, the tool initially behaves as a common pair of pliers when there is no resistive torque at the jaw set 316-320. Thus the handle set 314-318 and the jaw set 316-320 are free to open and close freely. The first bias compression spring 388 maintains the first handle in a position away from the second handle 318, and in turn the fork portion 382 in a position toward the retaining pins 384. When an object is placed between the jaws, and a clamping torque is applied at the handle set 314-318, a reactive resistive torque is developed at the jaw set 316-320, which eliminates the free movement of the handles and the jaws. Under this restriction, the first handle is forced to overcome the force applied by the bias spring 388 and rotate around the second pivot 370, moving toward the second handle 318. The wedge connector 380 and the fork portion 382 are forced to move away from the retaining pins 384, and toward the central area of the hubs. As this is occurring, the fork portion 382 pushes the clutch section 336, which is the same as first wedge 332, toward the second hub 326, overcoming the bias force applied by the second bias spring 363 on the clutch section 336, until the inner clutching surface 338 engages with the outer clutching surface 322, thus causing the first member 310 to lock with respect to the second member 312. This locking is reversible, since after handling the object in a desired manner, the operator may release the clamping torque at will, resulting in movement of the first handle 314 away from the second handle 318 by the bias spring 388, causing in turn the fork portion 382 to move toward the pins 384, thus freeing the clutch section 336, which then is forced to move away from the second hub 326 by the second bias spring 363, resulting in disengagement of the inner clutching surface 338 from the outer clutching surface 322, thus reinstating the free movement of the first member 310 with respect to the second member 312 and dissolving the locking of the gripping tool. Since the inner clutching surface 338 and the outer clutching surface 322 are for all practical, when engaged they are considered to have flat engagement.

Figure 13:
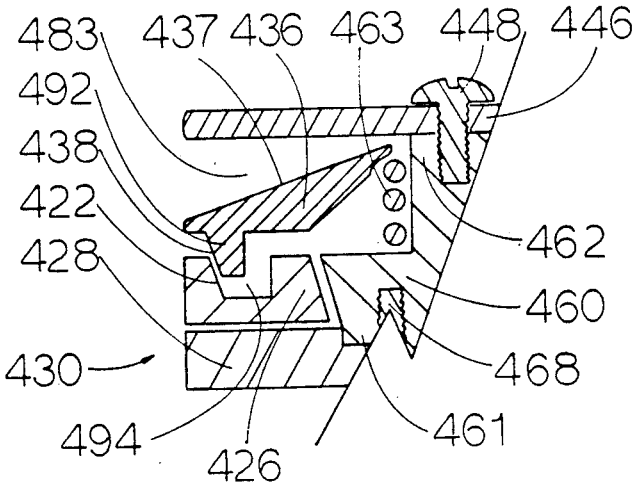
FIG. 13 shows a fragmented partial view of an alternative version of wedging means, in combination with part of the first and second hubs of the tool.

FIG. 13 illustrates a fragmented cross sectional view of a different preferred embodiment of a reversible wedging means 430, which may be used in place of wedging means 330, in a gripping tool of the type shown in FIGS. 10 an 11. The clutch section 436 has a wedge protrusion 492 with an inner clutching surface 438, commensurate to the outer clutching surface 422 of a wedge cavity 494 on the second hub 426. Both the wedge protrusion 492 and the wedge cavity 494 are circular all the way around the clutch section 436 and the second hub 426, respectively. The two clutching surfaces 438 and 422 are substantially parallel to each other.

In a similar manner as in the previous embodiment, the flat surface 437 of the clutch section 436 is in an angle with the cover plate 446, forming a first wedge configuration 432, in a way that if a solid object is forced to move in the wedging region toward the central area, where the clutch guide 462 is located, the clutch section 436 is forced to move toward the second hub 426. The clutch section 436 is kept away from the second hub 426 by second bias compression spring 463. At this position, the second hub 426 is free to turn around the first pivot 460, which is connected rigidly to the first hub 428 with bolts 468. The clutch guide 462, in this case also, has a non-circular cross section, and the clutch section 436 has a commensurate opening for the non-circular cross section of the clutch guide to fit in, so that if one is caused to turn the other one also must turn along with it, and if one is locked, the other cannot move either. Thus, the wedge 432 is directionally connected to the first hub 428.

The operation of a gripping tool as the one illustrated in FIGS. 10 and 11 having reversible wedging means as the means illustrated in FIG. 13, has substantially the same operation as the fourth embodiment described above, with the difference that the inner clutching surface and the outer clutching surface are engaged by a reversible wedging action instead of the roughness-based frictional action encountered in the fourth preferred embodiment of this invention. Thus, in this embodiment of the present invention, two reversible wedging mechanisms are involved. The preferred values of the angle formed by the inner and outer clutching surfaces with a line perpendicular to the plane of the tool are the same as those corresponding to angle Y, as discussed earlier. Of course, more than one pair of respective clutching surfaces may be used for stronger locking action. A protrusion and a respective cavity of the type shown in FIG. 13, but having cooperative equisided trapezoidal cross sections, as better illustrated in FIG. 14, are preferred as distributing better the forces involved.

Figure 14:
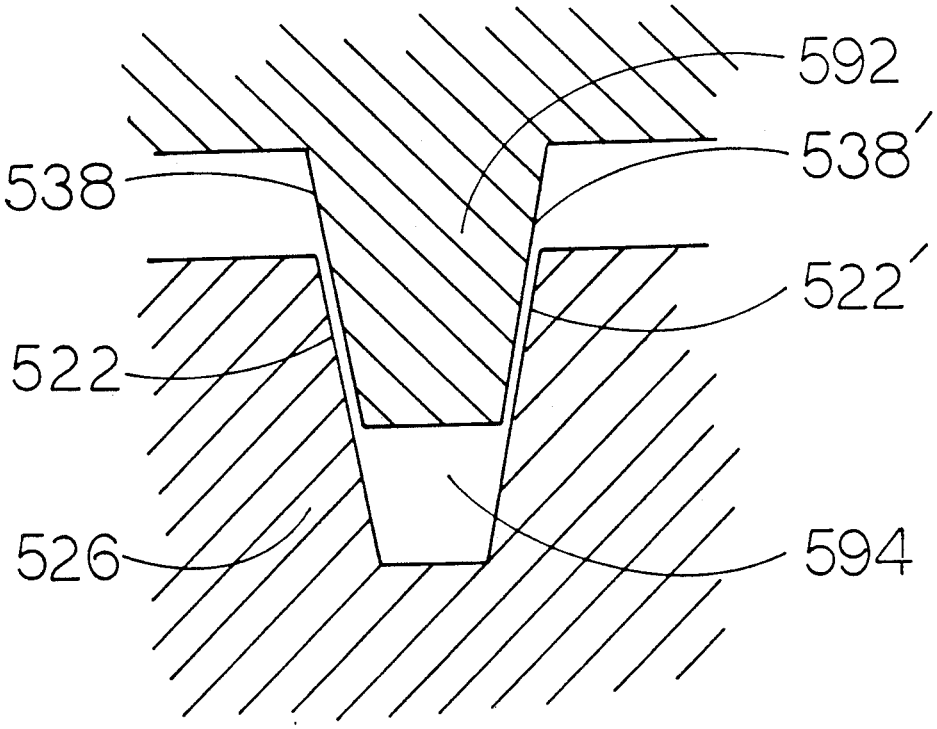
FIG. 14 is a fragmented cross sectional view of a wedge protrusion and a wedge cavity, each having an equisided trapezoidal cross section.

An example of equisided trapezoidal cross sections are illustrated in FIG. 14. The wedge protrusion 592 is commensurate to the wedge cavity 594, and both have trapezoidal cross sections, wherein each trapezoid has two sides equal to each other and corresponding to different clutching surfaces, such as 538 and 538' of the protrusion 592 matching clutching surfaces 522 and 522' of the cavity, respectively.

Returning now to FIG. 13, the strength of the spring 463, and the value of the aforementioned angle will determine whether the tool will unlock spontaneously when the clamping torque applied on the handle-set by the operator is released, or a reverse torque or push on the handle-set will be required to overcome remnant frictional forces. Larger angles, and stronger springs 463, favor spontaneous unlocking. On the other hand, smaller angles and weaker springs 463, favor the need for a reverse torque on the handle-set for final unlocking.

Deactivating means may also be used in such cases in which the handle 314 is pivoted on an extension 372 of the first hub 328, in the form for example of a deactivating pin (not shown) which, for example, may immobilize and free at will the first handle 314 with respect to the extension 372, in any number of conventional ways.

It becomes more clear now, that also the inner and outer clutching surfaces 38 and 22, respectively, shown in the embodiments illustrated in FIGS. 1 to **9*b*** could be made in the form of wedge protrusion and wedge cavity, preferably of the equisided trapezoidal type, so that if either one of the two is a wedge protrusion, the other is a commensurate wedge cavity.

Also, the engaging surfaces of the first and second engaging means disclosed in U.S. Pat. No. 4,890,520, which is incorporated herein by reference, may be made in the form of an inner clutching surface and an outer clutching surface, the two surfaces being part of a wedge protrusion and a wedge cavity, of preferably equisided trapezoidal cross sections.

As shown in the above embodiments, many elements of this invention, and especially of the wedging means, may play a multiple or a single role, depending on the particular desired design.

A very important attribute of the reversible wedging mechanisms of this invention is that the tremendous forces developed among the clutching surfaces produce sufficient friction without the need of appreciable roughness. For easier manufacturing, it is preferred that the protrusions and cavities are on the flat surfaces (surfaces parallel to the plane of the tool) of the tool than on the side surfaces of the tool.

In conclusion, the particular embodiments discussed above are only given as examples and should not be considered as limiting factors to the scope of the present invention. Although certain combinations of preferred parameters were given as examples, any other combination of the cited parameters lies within the realm of this invention, depending on the application and intended use of the gripping tool.

It should be noted that numerals differing by multiples of 100 utilized to describe the different embodiments of this invention, represent substantially the same elements, intended in general to perform substantially the same functions, and should be used as such for a better understanding of the different aspects of the instant invention.

What is claimed is:

1. A self-locking gripping tool comprising in combination an assembly of:

(a) a first member having a first hub, a first jaw rigidly connected to the first hub, and a first handle extending from the first hub in a direction substantially opposite to the direction of the first jaw;

(b) a second member having a second hub, a second jaw rigidly connected to the second hub, and a second handle extending from the second hub in a direction substantially opposite to the direction of the second jaw, the second member being pivotally connected to the first member through a first pivot hole on the second hub, the first handle and the second handle constituting a handle set, and the first jaw and the second jaw constituting a jaw set, and the second hub having an outer clutching surface; and (c) wedging means for reversibly locking the tool, comprising a clutch section having an inner clutching surface commensurate to the outer clutching surface, and a first wedge directionally coupled with the first hub, and being adaptable to create adequate pressure between the inner clutching surface and the outer clutching surface, so as to reversibly lock the second member with respect to the first member when a clamping torque exceeding a predetermined value is applied on the handle set, the clamping torque corresponding to a simultaneous resistive torque created on the jaws by an object gripped in the jaw set.

2. A gripping tool as defined in claim 1, wherein the inner clutching surface is directionally coupled with the first hub.

3. A gripping tool as defined in claim 1, wherein the first pivot hole and the outer clutching surface coincide.

4. A gripping tool as defined in claim 1, wherein the wedging means further comprise means for reducing friction between the wedge and the clutch section.

5. A gripping tool as defined in claim 4, wherein the friction-reducing means comprise rollers.

6. A gripping tool as defined in claim 4, wherein the friction-reducing means comprise balls.

7. A gripping tool as defined in claim 1, further comprising means for deactivating at will the first wedge and precluding the tool from being adaptable to create adequate pressure between the inner clutching surface and the outer clutching surface, thus temporarily preventing the second member to reversibly lock with respect to the first member, and allowing the gripping tool to be used temporarily as a regular pair of pliers.

8. A gripping tool as defined in claim 7, wherein the deactivating means comprise a sliding pin having a push-in position for deactivating or activating the first wedge, and a push-out position for activating or deactivating the first wedge, respectively.

9. A gripping tool as defined in claim 7, wherein the deactivating means comprise a rotational pin having a turn-left position for deactivating or activating the first wedge, and a turn-right position for activating or deactivating the first wedge, respectively.

10. A gripping tool as defined in claim 1, wherein the inner clutching surface and the outer clutching surface have circular engagement.

11. A gripping tool as defined in claim 1, wherein the inner clutching surface and the outer clutching surface have flat engagement.

12. A gripping tool as defined in claim 1, wherein the inner clutching surface is in the form of a wedge protrusion or a wedge cavity and the outer clutching surface is in the form of a commensurate wedge cavity or wedge protrusion, respectively.

13. A gripping tool as defined in claim 12, wherein the first wedge coincides with the inner clutching surface.

14. A gripping tool as defined in claim 12, wherein the wedge protrusion and the wedge cavity have equisided trapezoidal cross sections.

15. A gripping tool as defined in claim 1, wherein the first wedge and the clutch section are integral parts of each other.

16. A gripping tool as defined in claim 1, wherein the first handle is pivotally extended from the first hub, and wherein the gripping tool further comprises a first spring for biasing the first handle away from the second handle, and a second spring for biasing the clutch section away from the second hub.

17. A gripping tool as defined in claim 16, further comprising a branch integrally connected to and extending from the first handle toward the second handle, a fork portion, and a wedge connector pivoted at one end on the branch and connected at the other end to the fork, in a manner that when the clamping torque exceeding the predetermined value is applied on the handle set, the fork causes the first wedge to move toward the second hub, and the inner clutching surface to engage with the outer engaging surface, thus reversibly locking the first member with respect to the second member.

18. A gripping tool as defined in claim 1, wherein the first wedge is rigidly connected to the first hub.

* * * * *